US005674015A

United States Patent [19]

Koyama et al.

[11] Patent Number: 5,674,015

[45] Date of Patent: Oct. 7, 1997

[54] ARRANGEMENT OF ACTUATORS AND TIP ENDS IN A WIRE DOT PRINT HEAD

[75] Inventors: Tatsuya Koyama; Tatsuhiko Shimomura; Masahiro Hatano, all of Tokyo, Japan

[73] Assignee: Oki Electric Industry Co., Ltd., Tokyo, Japan

[21] Appl. No.: 419,599

[22] Filed: Apr. 10, 1995

[30] Foreign Application Priority Data

Apr. 22, 1994 [JP] Japan ..... 6-084616

[51] Int. Cl.[6] ..... B41J 2/265

[52] U.S. Cl. ..... 400/124.24; 400/124.28; 400/124.18

[58] Field of Search ..... 400/124.11, 124.12, 400/124.14, 124.17, 124.18, 124.24, 124.28, 124 TA

[56] References Cited

U.S. PATENT DOCUMENTS 5,190,382 3/1993 Koshiishi et al. ..... 400/124.28

FOREIGN PATENT DOCUMENTS

| | | | |
|---|---|---|---|
| 58-090965 | 5/1983 | Japan | 400/124.28 |
| 60-212361 | 10/1985 | Japan | 400/124.28 |
| 1-040345 | 2/1989 | Japan | 400/124 TA |
| 3-009861 | 1/1991 | Japan | 400/124.28 |
| 3-024968 | 2/1991 | Japan | 400/124.28 |

*Primary Examiner*—David A. Wiecking
*Attorney, Agent, or Firm*—Rabin, Champagne & Lynt, P.C.

[57] ABSTRACT

Plural guide holes are arranged in a matrix form in a wire guide. Plural print drivers are circularly arranged in plural layers for first print drivers belonging to a layer near to the wire guide and for second print drivers belonging to a layer far from the wire guide. A print wire is provided at each print driver so as to project end thereof from the guide hole of the wire guide when driven. The print wires formed at the first print drivers are inserted in the guide holes of lines located at the edge formed in the wire guide. On the other hand, the print wires formed at the second print drivers are inserted in the guide holes of lines located at the center of the wire guide.

11 Claims, 7 Drawing Sheets

ARRANGEMENT OF ACTUATORS AND TIP ENDS IN A WIRE DOT PRINT HEAD

BACKGROUND OF THE INVENTION

1. Field of the Invention

This invention relates to a wire dot print head used for a serial printer or the like and, more particularly, to a wire dot print head whose print drivers are arranged circularly.

2. Description of Related Art

A spring charge type impact printer is known as one type of impact printer that prints on printing paper by striking through an ink ribbon with print wires thereof. The spring charge type impact printer is constituted so that each armature holding a print wire is swingably supported by a leaf spring for bias. The armature is attracted toward a core by a permanent magnet in opposition to the elastic force of the leaf spring for bias. A coil wound around the core is excited at the time of printing to produce magnetic flux in the opposite direction to the magnetic flux direction of the permanent magnet, thereby releasing the armature. Upon release of the armature, an end of the print wire projects from a guide hole formed in a wire guide toward a direction of a cylindrical platen to perform printing. A print driver is thus constituted of the armature, the leaf spring for bias, the core, the coil, and the permanent magnet. The wire guide is formed as a part of the wire dot print head facing the platen.

There is a printer having a double layer structure, among the spring charge type impact printers. Plural print drivers equipped with print wires are arranged circularly so as to form layers, which are disposed as a first layer near to the platen, or to the wire guide, and as a second layer far from the platen, or from the wire guide. First print drivers are composed of the plural print drivers belonging to the first layer nearest to the wire guide; second print drivers are composed of the plural print drivers belonging to the second layer farthest from the wire guide. This double layer structure of the print drivers increases the number of print wires to increase the printing speed, and prevents the size of the wire dot print head from becoming larger in a radial direction. Notably, the print wires formed at the second print drivers are made longer than those formed at the first print driver because the second print driver is located farther from the platen. The ends of the print wires formed at the first print drivers and the ends of the print wires formed at the second print drivers are held in a single plane to maintain a regular space gap between the print wire ends and the platen or printing paper.

The guide holes in the wire guide are arranged to constitute respective pairs, each pair of guide holes being arrayed (side by side) in a spacing direction, or a line direction, of the wire dot print head. Plural guide hole pairs are arranged in the wire guide in a direction perpendicular to the spacing direction of the wire dot print head to form two columns constituted of a left column and a right column in the spacing direction. One line is formed by a pair of guide holes of the left-side column and another line by a pair of guide holes of the right side column. A pair of guide holes of the left side column and a pair of guide holes of the right-side column, which form respective lines, are offset in a direction orthogonally intersecting the spacing direction.

Now, there exemplifies a wire dot print head in which twenty four print wires are provided for the first print drivers and the twenty four print wires are provided for the second print drivers. The twelve guide hole pairs form left and right columns, respectively, at the wire guide: twelve lines of the guide holes are arrayed vertically since one line is constituted by a guide hole pair of the left column and another line by a guide hole pair of the right column. A pair of guide holes of the left-side column and a pair of guide holes of the right-side column, which form respective lines, are offset in a direction orthogonally intersecting the spacing direction.

The wire dot print head of the double layer structure prints dots next to each other in the same pixel line by projecting the ends of the print wires formed at the first and second print drivers, respectively, from a pair of the guide holes next to each other in the same line. That is, ends of the print wires formed at first and second print drivers are inserted in a pair of the guide holes next to each other in the respective lines in the left column; the ends of the print wires formed at first and second print drivers are inserted in a pair of the guide holes next to each other in the respective lines in the right column. Therefore, whenever any pixel line is to be printed, the print wires formed at both print drivers always operate.

If distances of the print wires to reach the platen are compared, i.e., between print wires inserted in the guide holes located in lines at an edge of the wire guide and print wires inserted in the guide holes located in lines at the center of the wire guide, when the ends of the print wires are projected toward the platen, the distance of the print wires inserted in the guide holes located in the lines at the edge of the wire guide is longer than that at the center of the wire guide because of curvature of the platen where the platen is cylindrical. Accordingly, when the print wires inserted in the guide holes located in the lines at the edge and center of the wire guide are simultaneously driven, the print wires inserted in the guide holes located in the lines at the center of the wire guide print pixels more quickly than those at the edge, and return to their original positions. Time from excitation of the coil to return of the print wire to its original positions more quickly is hereinafter referred as to printing time.

In contrast, if the lengths of the print wires in the same line are compared, the print wire formed at the second print driver is longer than the print wire formed at the first print driver. Accordingly, the print wire formed at the second print driver is heavier than that at the first print driver due to the difference between their lengths. When the print wires formed at the first and second print drivers are simultaneously driven, the print wire formed at the first print driver can therefore print with a shorter printing time than the print wire formed at the second print driver.

Summarizing these factors, the print wire inserted in the guide hole in the line at the edge of the wire guide and formed at the second print driver prints with the longest printing time and, in other words, has the worst printing response among all the print wires. On the other hand, the print wire inserted in the guide hole in the line at the center of the wire guide and formed at the first print driver prints with the shortest printing time and, in other words, has the best printing response among all the print wires. If the printing time is long, the printing speed becomes low; if the printing time is short, the printing speed becomes high. The printing speed is determined by and limited to the print wire whose printing speed is lowest and whose printing response is inferior because the printing speed must be identical at all print wires. As a result, the problem of low printing speed arises.

SUMMARY OF THE INVENTION

It is an object of the invention to provide a wire dot print head with high printing speed.

It is another object of the invention to provide a wire dot print head, easily assembled, printing with high speed.

In order to accomplish the objects above, the wire dot print head according to the invention includes a wire guide arranging guide holes in a matrix form, a plurality of print drivers circularly arranged in plural layers composed of a layer near to the wire guide and a layer far from the wire guide, a plurality of print wires provided respectively at first print drivers belonging to the layer near to the wire guide and at second print drivers belonging to the layer far from the wire guide and made to project ends thereof from the guide holes of the wire guide when driven, wherein the print wires formed at the first print drivers are inserted in the guide holes of lines located at the edge of the wire guide and the print wires formed at the second print drivers are inserted in the guide holes of lines located at the center of the wire guide.

Accordingly, the print wires with the longest printing time come close to the center of the wire guide more than in the conventional. As a result, the printing speed will be improved because the distance of the print wires with the longest printing time to reach the cylindrical platen becomes shorter than that in the conventional.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF THE PREFERRED EMBODIMENTS

Figure 1:
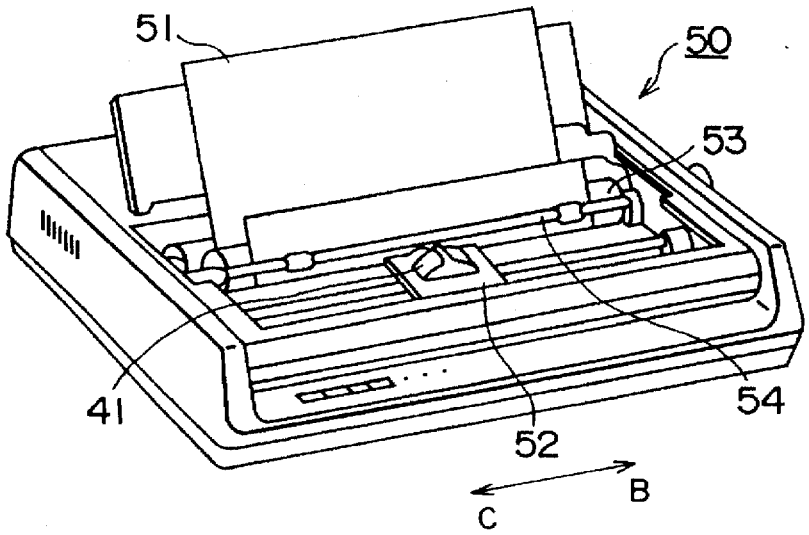
FIG. 1 is a schematic perspective view showing a printer.
Figure 2:
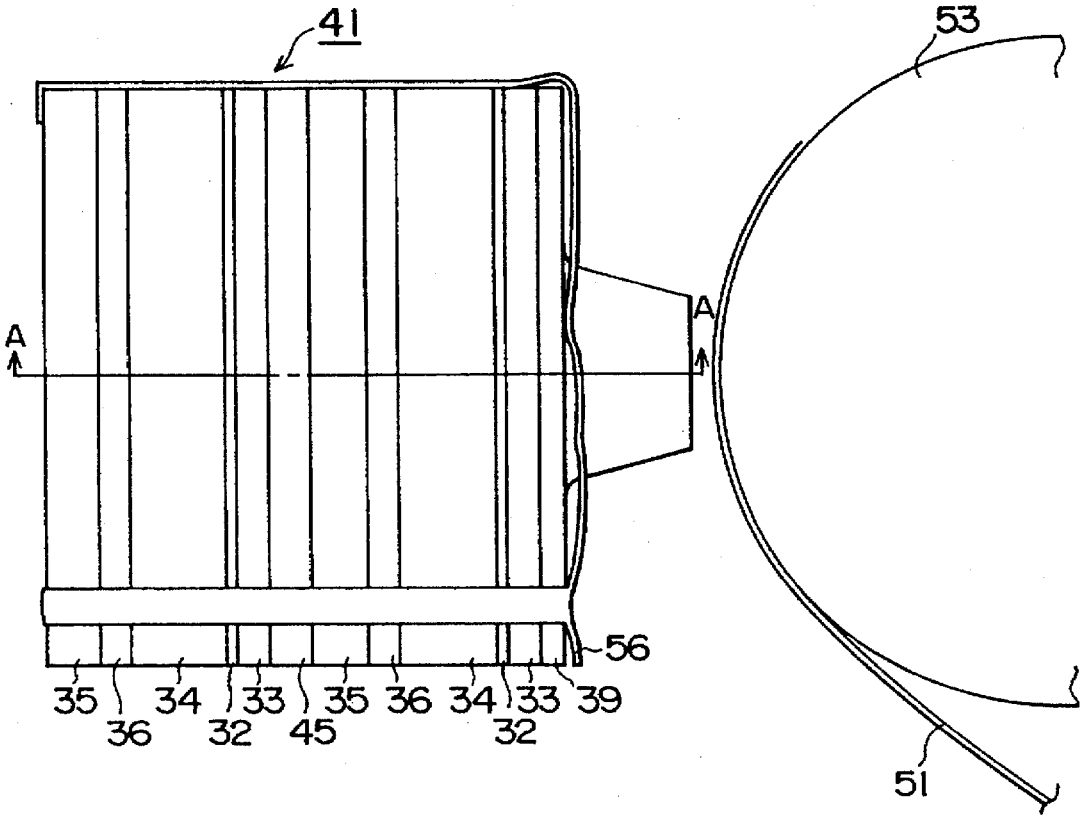
FIG. 2 is a side view showing a wire dot print head of an embodiment according to the invention.
Figure 3:
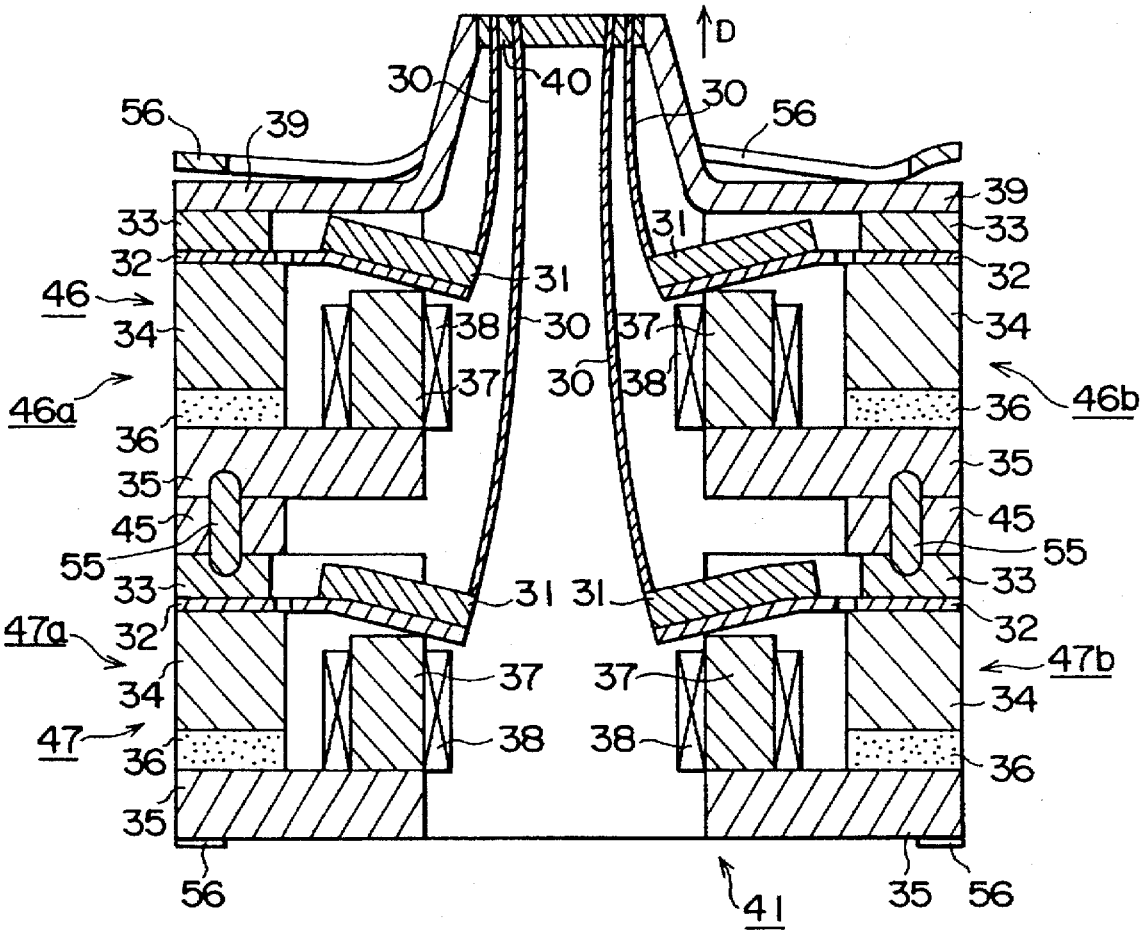
FIG. 3 is a cross section of a wire dot print head cut along A—A line in FIG. 2.
Figure 4:
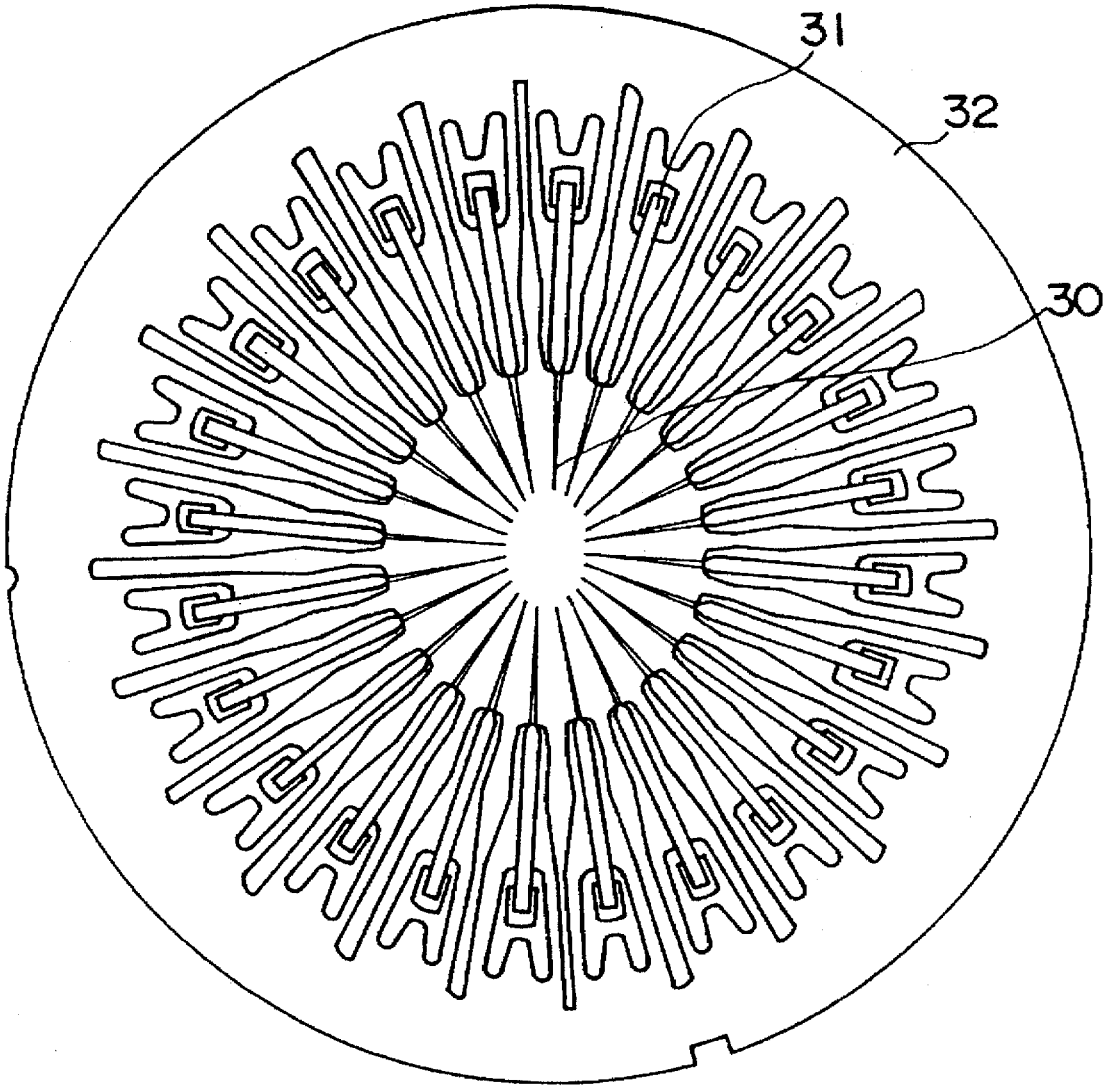
FIG. 4 is a plan view showing print wires, armatures, and leaf springs for bias of the wire dot print head in FIG. 2.
Figure 5:
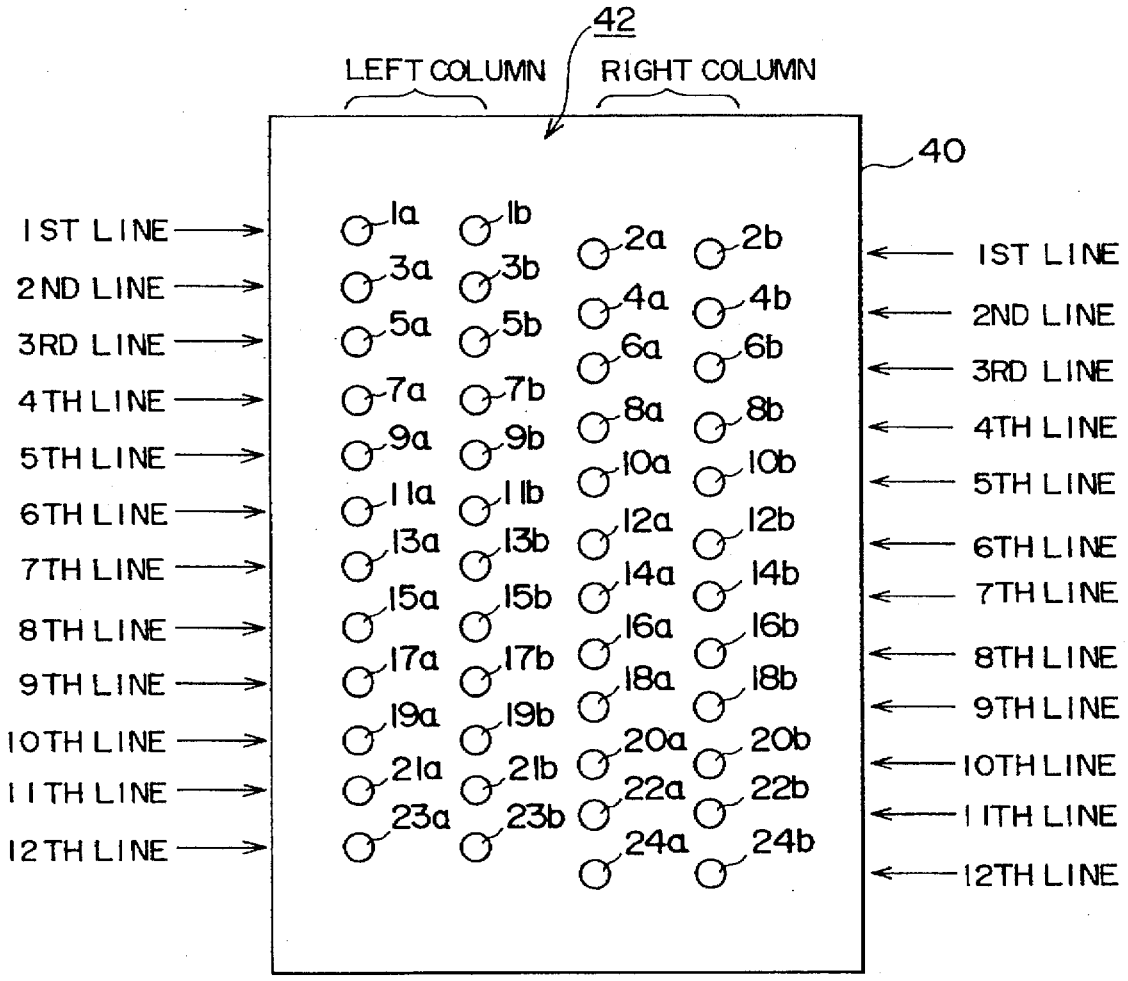
FIG. 5 is a plan view showing a wire guide of the wire dot print head in FIG. 2.
Figure 6:
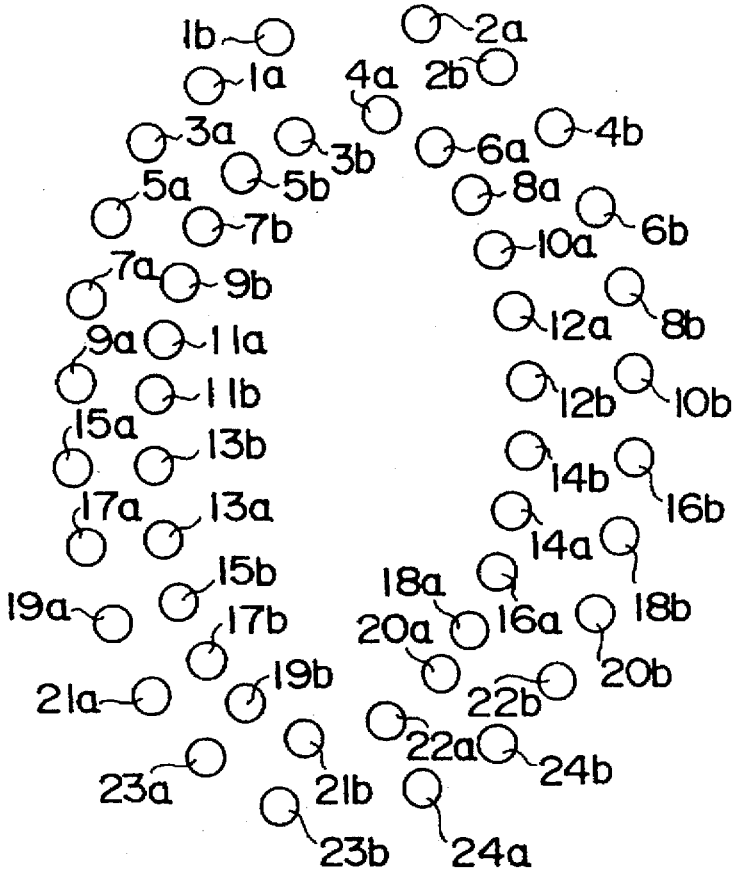
FIG. 6 is a cross-sectional view showing an array of print wires of the volume of two layers of the embodiment.

Referring to the drawings in detail, a wire dot print head according to a preferred embodiment of the invention is shown. The same reference numerals are given to common elements in the respective drawings. FIG. 1 is a schematic perspective view showing a printer; FIG. 2 is a side view showing a wire dot print head; FIG. 3 is a cross section of a wire dot print head cut along A—A line shown in FIG. 2; FIG. 4 is a plan view showing print wires, armatures, and leaf springs for bias; FIG. 5 is a plan view showing a wire guide; FIG. 6 is a cross-sectional view showing an array of print wires of the volume of two layers. In FIG. 2, other elements can be seen together for the sake of this description.

In FIG. 1, a printer 50 is formed with a wire dot print head 41 for printing on printing paper 51. The wire dot print head 41 is mounted together with an ink ribbon 52 on a print head carriage (not shown). The wire dot print head 41 performs spacing motions in Arrow B-C directions in association with the motions of the print head carriage. A cylindrical platen 53 is provided in the printer 50 to oppose the wire dot print head 41 and the ink ribbon 52. By rotations of the platen 53, the printing paper 51 is carried between the platen 53 and the wire dot print head 41. The wire dot print head 41, while performing spacing motions, prints on the printing paper 51 with the ink ribbon 52. A paper bail 54 pushes the printing paper 51 onto the platen 53 to prevent the printing paper 51 from tilting during printing.

Next, the wire dot print head 41 is described. As shown in FIG. 2, a base yoke 35, a permanent magnet 36, a yoke 34, a leaf spring for bias 32, and an armature yoke 33 are secured onto both sides of a spacer (yoke) 45 in a sequentially stacked condition in the wire dot print head 41. A guide frame 39 is secured to the armature yoke 33 located on a side nearest to the platen 53 facing to the platen 53. The entire body of the wire dot print head 41 is held together by a clamp 56.

As shown in FIG. 3, a core 37 is fixed to the base yoke 35 positioned inside the yoke 34 and the permanent magnet 36. A coil 38 is wound outside the core 37 to form an electromagnet, and electromagnets of a number, which corresponds to the number of print wires 30, are circularly arranged. Terminals (not shown) of each coil 38 are connected onto a printed circuit board (not shown). An end of a respective leaf spring 32 for bias projects in a cantilevered manner toward the center of the head so as to correspond to a respective core 37 of the electromagnet. A respective armature 31 is secured to the end of a respective leaf spring 32 for bias opposite to core 37 of the electromagnet (37, 38).

As shown in FIGS. 3, and 4, each print wire 30 is fixed to an end of an armature 31, and an end of the print wire 30 is slidably inserted through one of the guide holes 42 (shown in FIG. 5) of a wire guide 40 secured to the guide frame 39 shown in FIG. 3 and thereby positioned. Each of the print drivers 46*a*, 46*b*, 47*a*, 47*b* is constituted of an armature 31, a leaf spring for bias 32, an armature yoke 33, a yoke 34, a base yoke 35, a permanent magnet 36, a core 37, and a coil 38. The print drivers 46*a*, 46*b*, 47*a*, 47*b* constitute a double layer structure composed of a layer nearest to the platen 53, or the wire guide 40, and a layer farthest from the platen 53, or the wire guide 40, through the spacer 45. (Ends of) print wires 30, in cross-section, of first print drivers 46 (46*a*, 46*b*) belonging to the layer nearest to the wire guide 40 constitute an outer substantially elliptical shape shown in FIG. 6; (ends of) the print wires 30, in cross-section, of second print drivers 47 (47*a*, 47*b*) belonging to the layer farthest from the wire guide 40 constitute an inner substantial ellipse shape shown in FIG. 6. As shown in FIG. 3, the base yoke 35 on a side of the first print drivers 46 (46*a*, 46*b*) and the armature yoke 33 on the side of the second print drivers 47 (47*a*, 47*b*) are circumferentially positioned by knock pins 55 through the spacer 45. Thus, positions of the first print drivers 46 and the second print drivers 47 are never shifted relative to each other in the circumferential direction.

In this exemplary embodiment, there are provided twenty four print drivers constituting first print drivers 46, and twenty four print drivers constituting second print drivers 47. Accordingly, twenty four print wires 30 of this embodiment are provided at the first print drivers 46, and twenty four print wires 30 of this embodiment are provided at the second print drivers 47. In FIG. 5, because the wire dot print head 41 having the double layer structure prints dots in the same pixel line by using two print wires 30, two of the guide holes 42 are juxtaposed in a spacing direction, or a line direction, to form a pair. The guide holes 42 are formed on the wire guide 40 by a pair on the left side and by a pair on the right side in the spacing direction of the wire dot print head 41. Twelve pairs of guide hole 42 are arranged in a direction perpendicular to the spacing direction of the wire dot print head 41 and constitute two columns, a left column and a right column, in the spacing direction by wire dot print head 41. One line is constituted of the one pair of guides holes 42 in the left column and another line is constituted by another in the right column. A pair on guide holes 42 of the left-side and a pair of guide holes 42 on the right-side, which form two lines, are further arranged in respective rows offset in a direction orthogonally intersecting the spacing direction.

As shown in FIG. 5, the guide holes 42 are formed, respectively, in twelve lines with the guide hole numbers 1*a*, 1*b* through 23*a*, 23*b* in the left column, and twelve lines within guide hole numbers 2*a*, 2*b* through 24*a*, 24*b* in the right column. The print wires 30 shown in cross-section in FIG. 6 are assigned to the same numbers as the numbers of the corresponding guide holes into which the print wires are inserted.

As shown in the cross-section of FIG. 6, print wires 30 formed at the first print drivers 46 are inserted in the guide holes 42 assigned to the guide hole numbers 1*a*, 1*b*, 2*a*, 2*b*, 23*a*, 23*b*, 24*a*, 24*b* of the lines at the edge, while the ends of print wires 30 formed at the first and second print drivers 46, 47, are respectively inserted in pairs of the guide holes juxtaposed to each other in the same line in a range between the guide hole numbers 3*a*, 3*b*, 4*a*, 4*b*, 21*a*, 21*b*, 22, and 22*b*, which are adjacent to the line at the edge, and the guide hole numbers 9*a*, 9*b*, 10*a*, 10*b*, 15*a*, 15*b*, 16, and 16*b*, which are adjacent to two central lines in which the guide holes are assigned to the guide hole numbers 11*a*, 11*b*, 12*a*, 12*b*, 13*a*, 13*b*, 14*a*, and 14*b*. That is, print wires 30 formed at the first print drivers 46 are inserted in the guide holes 42 assigned to the guide hole numbers 3*a*, 5*a*, 7*a*, 9*a*, 15*a*, 17*a*, 19*a*, and 21*a* in the left column. Print wires 30 formed at the second print drivers 47 are inserted in the guide holes 42 assigned to the guide hole numbers 3*b*, 5*b*, 7*b*, 9*b*, 15*b*, 17*b*, 19*b*, and 21*b* in the left column. On the other hand, print wires 30 formed at the second print drivers 47 are inserted in the guide holes 42 assigned to the guide hole numbers 4*a*, 6*a*, 8*a*, 10*a*, 16*a*, 18*a*, 20*a*, and 22*a* in the right column. Print wires 30 formed at the first print drivers 46 are inserted in the guide holes 42 assigned to the guide hole numbers 4*b*, 6*b*, 8*b*, 10*b*, 16*b*, 18*b*, 20*b*, and 22*b* in the right column. Print wires 30 formed at the second print drivers 47 are inserted in the guide holes 42 assigned to the guide hole numbers 11*a*, 11*b*, 12*a*, 12*b*, 13*a*, 13*b*, 14*a*, 14*b* of the two central lines.

Figure 7:
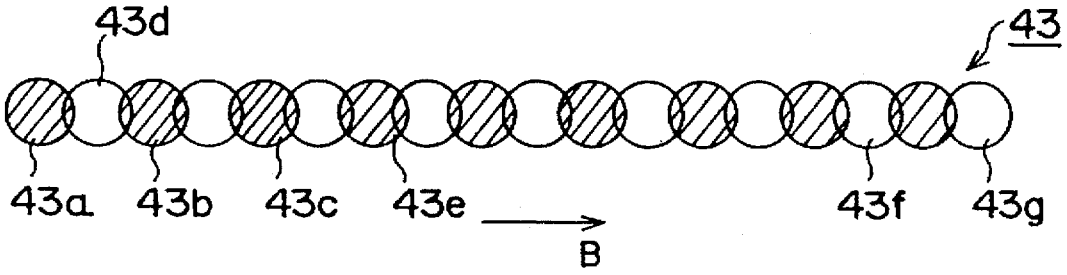
FIG. 7 is an illustration showing a pixel line.

Referring to the drawings, printing operation of the wire dot print head 41 thus constituted is described as follows. FIG. 7 is an illustration describing one pixel line. In FIG. 3, when the flux of the permanent magnet 36 passes through a magnetic circuit composed of the yoke 34, the armature yoke 33, the armature 31, the core 37, and the base yoke 35, the armature 31 is attracted toward the core 37 and is in a biased condition. That is, the leaf spring 32 for bias supporting the armature 31 is bent, thereby accumulating strain energy therein. When the coil 38 is excited to produce flux in the opposite direction to the flux produced by the permanent magnet 36, the fluxes of the permanent magnet 36 and the coil 38 cancel mutually. The strain energy accumulated in the leaf spring 32 for bias is then released, and therefore the leaf spring 32 for bias is bent back. Upon bending back of the leaf spring 32 for bias, the end of the print wire 30 attached to the armature 31 projects from the guide hole 42 shown in FIG. 5, thereby pushing, via the ink ribbon 52, the printing paper 51 onto the platen 53, as shown in FIG. 1. By this operation, the wire dot print head can print letters or characters and graphic patterns.

In FIGS. 3, 6, and 7, for example, if one pixel line 43 is to be printed by print wires 30 assigned to wire numbers 1*a*, 1*b*, the print wire associated with number 1*a* projects toward the direction indicated by Arrow D according to the printing operation above and, while performing a spacing motion in the direction of Arrow B, prints dots 43*a*, 43*b*, 43*c* in this order. The print wire 30 associated with number 1*b* then prints a dot 43*d*. The print wire 30 associated with number 1*a* subsequently prints a dot 43*e*. The print wire 30 associated with number 1*b*, while performing a spacing motion in the Arrow B direction, prints dots 43*f* and 43*g* in this order, and thereby the wire dot print head 41 completes printing of the one pixel line 43. Thus, the print wires 30 associated with numbers 1*a*, 1*b* print dots next to each other, respectively. In FIG. 7, hatched dots represent dots printed by the print wire 30 associated with number 1*a*; blank dots represent dots printed by the print wire 30 associated with number 1*b*.

As described above, the print wires 30 formed at the first print drivers 46 are inserted in the guide holes 42 assigned to the guide hole numbers 1*a*, 1*b*, 2*a*, 2*b*, 23*a*, 23*b*, 24*a*, 24*b* of the lines at the edge, so that the printing time of the print wires 30 inserted in the guide holes 42 of the lines at the edge of the wire guide 40 becomes shorter than the conventional arrangement. Regarding the print wires 30 inserted at the guide holes 42 assigned to the guide hole numbers 11*a*, 11*b*, 12*a*, 12*b*, 13*a*, 13*b*, 14*a*, 14*b* of the two central lines, even though the printing time becomes longer since the print wires 30 are formed at the second print drivers 47, the distance to reach the platen 53 from the wire guide 40 is the shortest among the entire print wires 30 because the print wires 30 are inserted in the guide holes 42 of the two central lines. Therefore, the longer printing time of the print wires 30 inserted at the guide holes 42 assigned to the guide hole numbers 11*a*, 11*b*, 12*a*, 12*b*, 13*a*, 13*b*, 14*a*, 14*b* of the two central lines is counterbalanced by the shorter distance thereof, thereby preventing the printing speed of the entire wire dot print head 41 from lowering due to the longer printing time.

Consequently, although in the conventional wire dot print head print wires 30 formed at the second print drivers 47 and inserted in the guide holes 42 of the lines at the edge of the wire guide 40 have the longest printing time, print wires 30 formed at the second print drivers 47 and inserted in the guide holes 42 of the guide hole numbers 3*b*, 4*a*, 21*b*, 22*a* have the longest printing time in this embodiment. Accordingly, the printing speed is determined by the printing time the print wires 30 inserted in the guide holes 42 of the guide hole numbers 3*b*, 4*a*, 21*b*, 22*a*. The print wires 30 with the longest printing time come closer to the guide holes 42 of the central lines of the wire guide 40 than the conventional arrangement. As a result, the distance of the print wire 30 with the longest printing time to the platen 53 from the wire guide 40 becomes shorter than that of the conventional arrangement, so that the printing speed is improved by the shorter distance.

Figure 8:
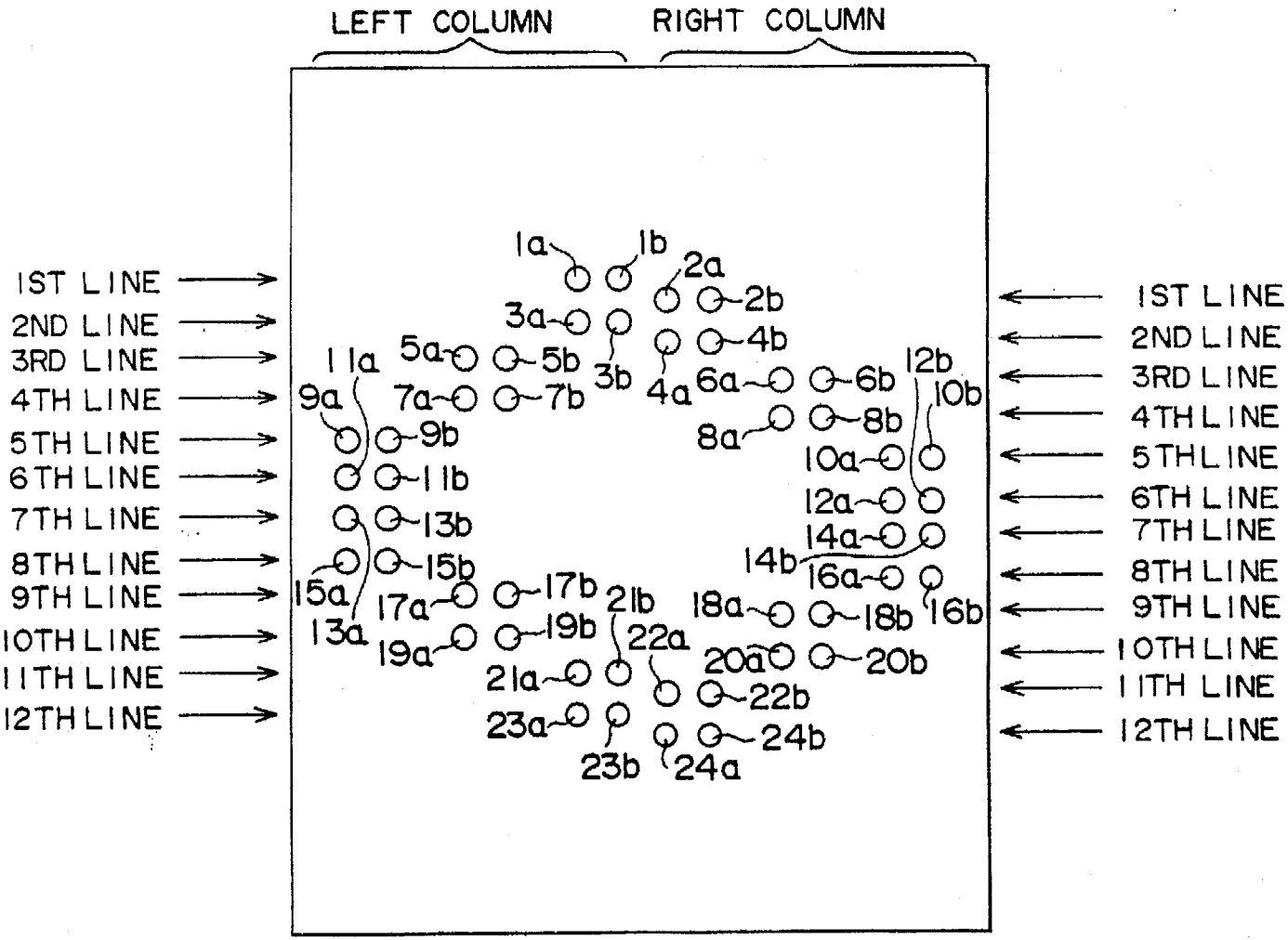
FIG. 8 is a plan view showing another wire guide.

As shown in FIG. 8, which is a plan illustration indicating another wire guide, the arrangement of the guide holes 42 in the wire guide 40 can be such that the guide holes 42 constituting each pair of lines are spaced further apart from each other as they come closer to the center in the column direction. If thus constituted, the wire dot print head 41 can reduce the number of the print wires driven at the same time when a character or a letter which is vertically long is to be printed. That is, the wire dot print head 41 can reduce noise as driven dispersedly. If many print wires 30 are driven at the same time, magnetic interference more often occurs in the wire dot print head 41, and therefore, energy for driving the print wires 30 and energy for overcoming the magnetic interference are both required to drive the print wires 30. However, if the number of print wires 30 to be driven at the same time is reduced, the magnetic interference is lessened. Accordingly, the wire dot print head 41 requires, as necessary energy, no more than the amount for driving the print wires 30 and can as a result improve energy efficiency.

Figure 9:
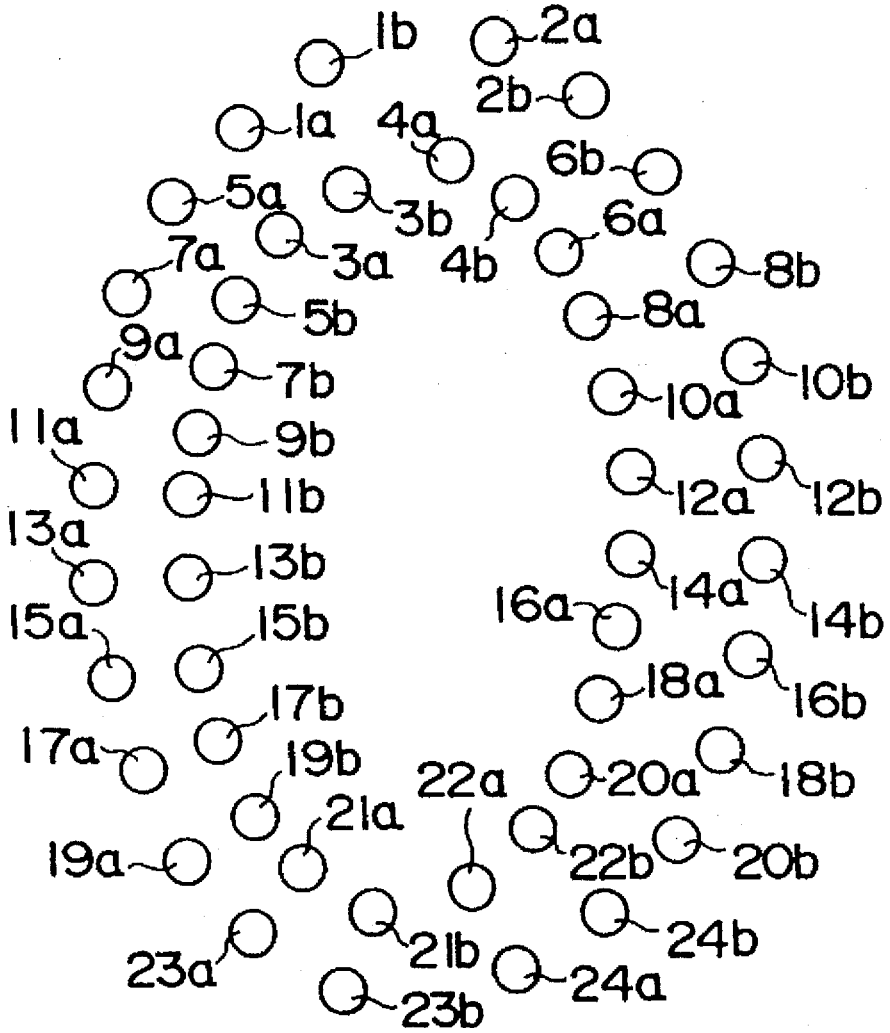
FIG. 9 is a cross-sectional view showing an array of print wires in the volume of two layers of another embodiment.

With this invention, the print wires 30 can be arranged in association with another preferred insertion into the guide holes 42 of the wire guide 40. FIG. 9 is an enlarged plan view partially showing an array of print wires in the volume of two layers of another embodiment. As another insertion arrangement of the print wires 30 inserted in the guide holes 42, the print wires 30 formed at the first print drivers 46 are inserted in the guide holes 42 assigned to the guide hole numbers of 1*a*, 1*b*, 2*a*, 2*b*, 23*a*, 23*b*, 24*a*, and 24*b* of the lines at the edge of the wire guide 40 and are arranged thereat as shown in FIGS. 5 and 9. The print wires 30 formed at the second print drivers 47 are inserted in the guide holes 42 assigned to the guide hole numbers of 3*a*, 3*b*, 4*a*, 4*b*, 21*a*, 21*b*, 22*a*, and 22*b* adjacent to the lines at the edge, or second lines from the lines at the edge, and are arranged thereat.

The ends of the print wires 30 formed at the first and second print drivers 46, 47 are inserted in the guide holes 42, constituting a pair, next to each other in each line in a range between the guide holes 42 of the guide hole numbers of 3*a*, 3*b*, 4*a*, 4*b* located in the second lines from the guide holes 43 of the guide hole numbers of 1*a*, 1*b*, 2*a*, 2*b* in the lines at the edge and the guide holes 42 of the guide hole numbers of 21*a*, 21*b*, 22*a*, 22*b* located in the second lines from the guide holes 43 of the guide hole numbers of 23*a*, 23*b*, 24*a*, 24*b* in the lines at the other edge. That is, the print wires 30 formed at the first print drivers 46 are inserted in the guide holes 42 of the guide hole numbers of 5*a*, 7*a*, 9*a*, 11*a*, 13*a*, 15*a*, 17*a*, 19*a* in the left column. The print wires 30 formed at the second print drivers 47 are inserted in the guide holes 42 of the guide hole numbers of 5*b*, 7*b*, 9*b*, 11*b*, 13*b*, 15*b*, 17*b*, 19*b* in the left column. The print wires 30 formed at the second print drivers 47 are inserted in the guide holes 42 of the guide hole numbers of 6*a*, 8*a*, 10*a*, 12*a*, 14*a*, 16*a*, 18*a*, 20*a* in the right column. The print wires 30 formed at the first print drivers 46 are inserted in the guide holes 42 of the guide hole numbers of 6*b*, 8*b*, 10*b*, 12*b*, 14*b*, 16*b*, 18*b*, 20*b* in the right column.

With the constitution above, because the print wires 30 to be inserted in each pair of the guide holes 42 next to each other of the guide hole numbers of 5*a*, 5*b* through 19*a*, 19*b* on the left column and of the guide hole numbers of 6*a*, 6*b* through 20*a*, 20*b* on the right column are formed at the first and second print drivers 46, 47, respectively, the print wires 30 can be smoothly inserted substantially straight into the guide holes 42 when inserted into the guide holes 42 in the same line when assembled. As a result, the wire dot print head 41 is easily assembled during the manufacturing process.

Moreover, because the print wires 30 inserted in the guide holes 42 of the guide hole numbers of 1*a*, 1*b*, 2*a*, 2*b*, 23*a*, 23*b*, 24*a*, 24*b* of the lines at the edge are formed at the first print drivers 46, the printing time of the print wires 30 inserted in the guide holes 42 in the lines at the edge of the wire guide 40 becomes shorter than the conventional. Accordingly, the print wires 30 with the longest printing time are those inserted in the guide holes 42 of the guide hole numbers of 3*a*, 3*b*, 22*a*, 22*b* and formed at the second print drivers 47. Consequently, the printing speed is determined by the printing time of the print wires 30 inserted in the guide holes 42 of the guide hole numbers of 3*a*, 3*b*, 22*a*, 22*b*. The print wires 30 with the longest printing time come to be closer to the guide holes 42 in the lines at the center than the conventional. As a result, the distance of the print wires 30 with the longest printing time to reach the platen 53 from the wire guide 40 becomes shorter than the conventional, thereby improving the printing speed.

It is to be noted that in this embodiment, the arrangement of the guide holes 42 in the wire guide 40 can be such that the guide holes 42 constituting a pair of each line are more spaced with each other as come close to the center in the column direction as shown in FIG. 8. If thus constituted, as well as described above, the wire dot print head 41 can reduce the number of the print wires 30 driven at the same time when a character or a letter vertically long is to be printed. As a result, the wire dot print head 41 can reduce noise and improve energy efficiency.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What is claimed is:

1. A wire dot print head comprising:

a wire guide having guide holes arranged in a matrix;

a plurality of print drivers circularly arranged in plural layers including a first layer nearest to said wire guide and a second layer farthest from said wire guide; and a plurality of print wires provided respectively to first print drivers of said first layer nearest to said wire guide and to second print drivers of said second layer farthest from said wire guide, ends thereof projecting from said guide holes of said wire guide when driven by said print drivers;

wherein said print wires of said first print drivers are inserted in ones of said guide holes which are disposed in rows at the edge of said wire guide, and said print wires of said second print drivers are inserted in ones of said guide holes which are disposed in rows at the center of said wire guide.

2. The wire dot print head as set forth in claim 1, wherein said print wires of said second print drivers are inserted in ones of said guide holes in two respective rows located at the middle of the respective columns of the matrix.

3. The wire dot print head as set forth in claim 2, wherein said wire guide has said guide holes arranged to form two columns of guide hole pairs, wherein each respective guide hole pair constitutes a single line, and wherein the guide hole pairs in one column and the guide hole pairs in the other column are offset from each other in the column direction.

4. The wire dot print head as set forth in claim 3, wherein said print wires of said first print drivers are inserted in guide hole pairs in the first and last rows of the columns;

wherein said print wires of said second print drivers are inserted in guide hole pairs in two rows at the respective middles of the columns; and wherein guide hole pairs between the first row and the middle two rows and between the middle two rows and the last row have inserted one print wire from each of the first and the second print drivers.

5. The wire dot print head as set forth in claim 1, wherein said guide holes comprise a plurality of columns of guide hole pairs, the columns being disposed progressively closer to an adjacent edge of the wire guide as the middle of the wire guide is approached.

6. The wire dot print head as set forth in claim 5, wherein said print wires of said first print drivers are inserted in guide hole pairs of the first and last rows;

wherein print wires of said second print drivers are inserted in guide hole pairs of the next to the first and the next to the last rows; and wherein guide hole pairs between the next to the first row and the next to the last row have inserted one print wire from each of the first and the second print drivers.

7. A wire dot print head comprising:

a wire guide having guide holes arranged in a matrix of rows and columns;

a plurality of print drivers circularly arranged in plural layers including a first layer nearest to said wire guide and a second layer farthest from said wire guide; and a plurality of print wires provided respectively to first print drivers of said first layer nearest to said wire guide and to second print drivers of said second layer farthest from said wire guide, ends thereof projecting from said guide holes of said wire guide when driven by said print drivers;

wherein said print wires of said first print drivers are inserted in ones of said guide holes which are disposed in rows at the edge of said wire guide, and said print wires of said second print drivers are inserted in ones of said guide holes which are disposed in rows adjacent to said guide holes located at the edge of said wire guide.

8. The wire dot print head as set forth in claim 7, wherein said wire guide has said guide holes arranged to form two columns of guide hole pairs wherein each respective guide hole pair constitutes a single line, wherein the guide hole pairs in one column and the guide hole pairs in the other column are offset from each other in the column direction.

9. The wire dot print head as set forth in claim 8, wherein print wires of said first print drivers are inserted in guide hole pairs of the first and last rows;

wherein print wires of said second print drivers are inserted in guide hole pairs of the next to the first and the next to the last rows; and wherein guide hole pairs between the next to the first row and the next to the last row have inserted one print wire from each of the first and the second print drivers.

10. The wire dot print head as set forth in claim 7, wherein said guide holes comprise a plurality of columns of guide hole pairs, the columns being disposed progressively closer to an adjacent edge of the wire guide as the middle of the wire guide is approached.

11. The wire dot print head as set forth in claim 10, wherein print wires of said first print drivers are inserted in guide hole pairs of the first and last rows;

wherein print wires of said second print drivers are inserted in guide hole pairs of the next to the first and the next to the last rows; and wherein guide hole pairs between the next to the first row and the next to the last row have inserted one print wire from each of the first and the second print drivers.

* * * * *